United States Patent [19]

Schreder

[11] Patent Number: 4,554,438

[45] Date of Patent: Nov. 19, 1985

[54] ELECTRIC COOKER WITH THERMOSTATS FOR PROTECTING AGAINST LOCALIZED OVERHEATING

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 603,329

[22] Filed: Apr. 24, 1984

[30] Foreign Application Priority Data

Apr. 28, 1983 [DE] Fed. Rep. of Germany ..... 3315333

[51] Int. Cl.[4] ..... H05B 3/68

[52] U.S. Cl. ..... 219/449; 219/452; 219/463; 219/512

[58] Field of Search ..... 219/446, 448, 449, 450, 219/451, 452, 453, 463, 464, 466, 512, 513

[56] References Cited

U.S. PATENT DOCUMENTS

| | | | |
|---|---|---|---|
| 2,321,815 | 6/1943 | Hull | 177/311 |
| 3,612,826 | 10/1971 | Deaton | 219/449 X |
| 3,636,309 | 1/1972 | Deaton et al. | 219/452 |
| 3,710,076 | 1/1973 | Frazier | 219/449 |
| 3,883,719 | 5/1975 | Hurko | 219/464 |
| 4,122,330 | 10/1978 | Fischer et al. | 219/449 |
| 4,303,827 | 12/1981 | Kyles | 219/512 |
| 4,350,875 | 9/1982 | McWilliams | 219/449 |
| 4,386,263 | 5/1983 | Fischer et al. | 219/449 |
| 4,388,520 | 6/1983 | McWilliams | 219/464 |
| 4,414,465 | 11/1983 | Newton et al. | 219/449 |
| 4,447,710 | 5/1984 | McWilliams | 219/449 |

FOREIGN PATENT DOCUMENTS

| | | | |
|---|---|---|---|
| 664707 | 9/1938 | Fed. Rep. of Germany . | |
| 1120099 | 12/1961 | Fed. Rep. of Germany . | |
| 1123059 | 8/1962 | Fed. Rep. of Germany . | |
| 1212648 | 6/1966 | Fed. Rep. of Germany | 219/449 |
| 2118407 | 10/1972 | Fed. Rep. of Germany . | |
| 7315318 | 7/1973 | Fed. Rep. of Germany . | |
| 2301928 | 8/1973 | Fed. Rep. of Germany | 219/449 |
| 2729929 | 1/1979 | Fed. Rep. of Germany . | |
| 2747652 | 4/1979 | Fed. Rep. of Germany | 219/449 |
| 2620004 | 5/1979 | Fed. Rep. of Germany . | |
| 2459649 | 10/1979 | Fed. Rep. of Germany . | |
| 3004187 | 8/1980 | Fed. Rep. of Germany . | |
| 2951409 | 2/1981 | Fed. Rep. of Germany | 219/464 |
| 3007037 | 9/1981 | Fed. Rep. of Germany . | |
| 3027998 | 2/1982 | Fed. Rep. of Germany . | |
| 3104265 | 4/1982 | Fed. Rep. of Germany . | |
| 3204119 | 11/1982 | Fed. Rep. of Germany . | |
| 2410790 | 6/1979 | France . | |
| 171335 | 5/1960 | Sweden | 219/449 |

*Primary Examiner*—Volodymyr Y. Mayewsky
*Attorney, Agent, or Firm*—Steele, Gould & Fried

[57] ABSTRACT

The cooker contains several conventional hotplates in a mounting plate. A thermostat is associated with each hotplate. However, the thermostat is not placed in or on the hotplate, but is instead located on the cooker, particularly between the hotplate and the edge or one of the corners of the mounting plate to protect against localized overheating apart from the hotplate.

19 Claims, 5 Drawing Figures

ELECTRIC COOKER WITH THERMOSTATS FOR PROTECTING AGAINST LOCALIZED OVERHEATING

BACKGROUND OF THE INVENTION

The invention relates to a cooker with several electric hotplates, particularly hotplates with a hotplate body having a substantially closed upper cooking surface, which are fitted into a mounting plate. A thermostat is provided for switching each hotplate, being connected to at least one of the leads thereof.

Conventionally, higher power electric hotplate have a thermostat, which is arranged on the hotplate, e.g. below the central area thereof and which responds to hotplate overheating, so that it switches off when inadvertently operated under no-load conditions, but normally also on exceeding a certain operating temperature, or is switched back to a lower power level. Such a thermostat is known from German Pat. No. 1,123,059.

German Pat. No. 2,620,004, corresponding to U.S. Pat. No. 4,122,330, discloses a thermal cut-out or thermostat, which is arranged therefore outside the space enclosed by the lower hotplate cover, but in which a temperature sensor also projects into said space, in order to be able to sense in an optimum manner the temperature of the hotplate or its heating system. In addition, a safety temperature switch is provided in the switch base and which also substantially responds to the hotplate temperature, in the same way as similar safety temperature switches provided on a connection metal sheet of the hotplate.

These thermostats are intended to detect overheating of the hotplate and to switch off the latter on exceeding a given temperature. As in the construction according to German Pat. No. 1,123,059, part of the power is switched off even when the hotplate is in a conventional temperature range, the residual power being sufficient to carry out normal cooking processes, but is too low to lead to unacceptable overheating.

SUMMARY OF THE INVENTION

The object of the invention is to protect a cooker having a plurality of electric hotplates in such away that, with minimum interference with of the power delivered to the actual hotplates, the cooker is protected against the effects of overheating.

This object is achieved in that the thermostats are arranged outside the hotplates and separately therefrom below the mounting plate on the cooker. Thus, as a result of this arrangement, it is not the actual hotplate which is protected against excessive temperatures, which is not generally necessary because the hotplate can withstand very high temperatures. Instead, it is the surrounding components which can be temperature-sensitive, e.g. a working plate in which a cooking tray is fitted, a switch or control strip on a cooker, etc which are protected. Nevertheless, it is not purely a thermal monitoring of the complete cooker and instead each thermostat is connected for controlling a specific hotplate. This not only has the advantage that the hotplate can be supplied prewired with the thermostat, but also that even when one thermostat operates to cut or interrupt power to its respective hotplate, the other hotplates can continue to be used. For example, the critical temperature can result from a heat build-up in a specific area of the cooker which is removed by switching off an individual hotplate, while the housewife can continue to work on the remaining hotplates.

Preferably, the thermostat is arrranged between the hotplate and the edge of the mounting plate. Generally, the temperature-sensitive components are located towards the edge of the mounting plate, so that this arrangement leads to a very good protection. The thermostat can be positioned in a random manner, e.g. on the edge of the mounting plate or the tray covering the bottom thereof, as well as on the bottom of the mounting plate or on other components. However, particular preference is given to fitting the thermostat to a fixing member for the particular hotplate, which normally brings about a bottom fixing to the mounting plate. The thermostat is far enough away from the hotplate to be removed from its direct temperature influence, but is still in a good position with respect to the ambient parts which are to be protected.

In the case of hotplates with several separately switchable heating conductors, the thermostat may only be connected to part of the heating conductors. Here again, it is normally sufficient if part of the power is switched off, particularly if the cooker does not have any particularly temperature-sensitive components, as is usually the case with a cooker made from enamelled sheet metal. Preferably, the thermostat is switched into a common lead for several heating conductors, so that e.g. in the case of a so-called seven-position hotplate which has three heating conductors, two of these can be jointly switched off. The thermostat can also be provided in addition to a thermal cut-out provided in the hotplate. Such thermal cut-outs can e.g. be provided in conjunction with the hotplate control, e.g. in the form of a heat control system operating with a hydraulic container or the like on the hotplate.

However, it is also possible to provide the thermostat in place of a thermal cut-out within the hotplate, if it is ensured that even under extreme operating conditions, the hotplate is able to withstand the temperature produced by it, as is the case with hotplates having closed cast iron hotplate bodies, which are designed for an average power level.

A thermostat can be provided on each flexible connecting lead emanating from the hotplate and can be fitted, preferably by means of a snap-on or slip-on fixing system. Thus, the thermostat can already be electrically connected to the hotplate and during assembly is fitted merely by a rapid fastening device located on it or on the cooker.

Features of the preferred further developments of the invention can be gathered from the description and drawings, the individual features being realisable either singly or in the form of random combinations.

BRIEF DESCRIPTION OF THE DRAWINGS

The invention is described in greater detail hereinafter relative to the nonlimiting embodiments shown in the attached drawings, wherein.

DETAILED DESCRIPTION OF THE PREFERRED EMBODIMENTS

Figure 1:
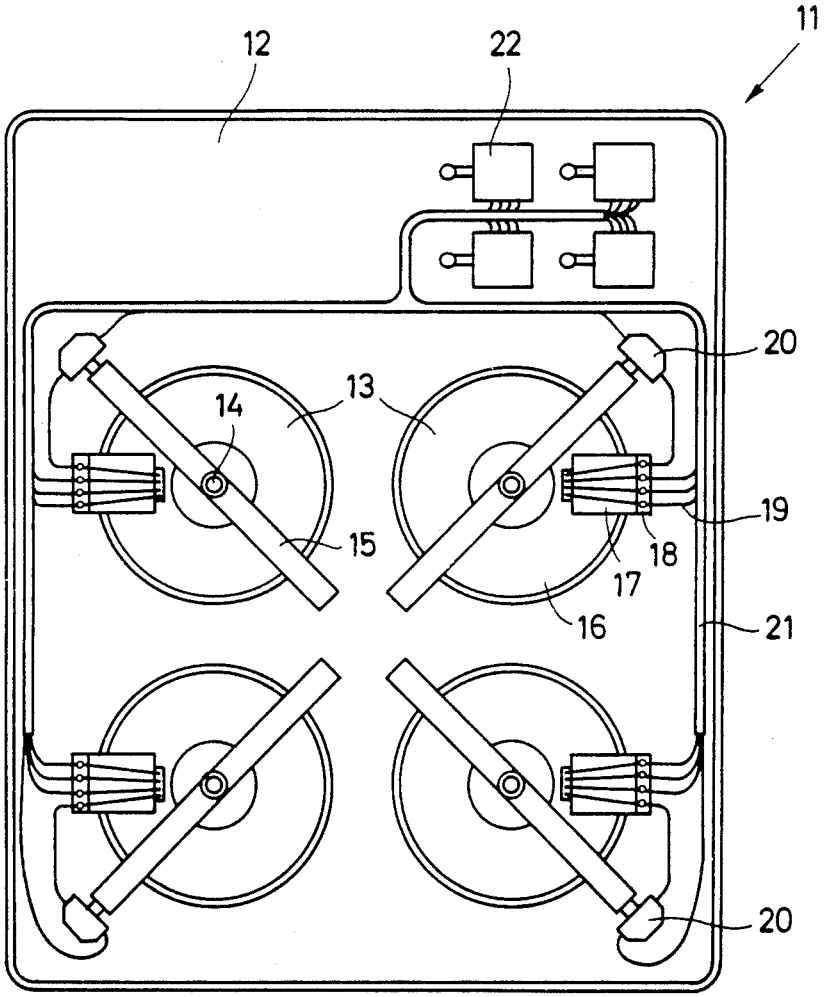
FIG. 1 is a bottom plan view of a mounting cooking tray with the cover removed cover.

A cooker 11 has a mounting plate 12 made from metal such as steel, e.g. enamelled steel sheets. The cooking tray is to be fitted into a working plate (not shown) of an article of kitchen furniture such as a cabinet, a countertop, or an appliance, and normally has a lower cover not shown, which closes off the tray at the bottom. The cooking tray is very flat and its overall height does not significantly exceed that of the switches or the hotplate thickness.

In mounting plate 12 are fitted four hotplates 13, equipped with conventional mounting sheet metal rings also called an overflow or spillage rim. The hotplates are introduced from above into circular cutouts in the mounting plate and are secured at the bottom against the mounting plate by means of a central screw 14 and a support member 15 projecting diagonally over the hotplate and whose edges are supported on the mounting plate 12. Sheet metal mounting plates are conventionally shaped upwards in the vicinity of the mounting openings for the hotplates, in order to form a rim to protect against cooking products flowing therethrough and to reinforce the mounting plate. This rim is not required when mounting plates are made from glass or ceramics.

The hotplates in the represented example are so-called seven-timing hotplates, i.e. hotplates with, in each case three separately switchable heating resistors, which are embedded in insulating material in slots formed on the bottom of the cast iron hotplate body. The hotplates are preferably convenitional hotplates with a closed upper, flat cooking surface.

The bottom of each hotplate is covered by a profiled cover plate 16, to which is laterally fitted a connection plate 17 projecting over the hotplate and to which is fixed a connection block 18 with terminals for the hotplate leads 19. The hotplates may or may not have an incorporated thermostat, which is normally positioned in the central area. These are conventional thermostats of the type disclosed by German Pat. No. 1,123,059, German Pat. No. 2,422,625 and DOS No. 3,027,998, corresponding to U.S. Pat. No. 4,386,263.

Thermal cut-outs 20 are arranged on the support members 15, towards the outer edge of the mounting plate and preferably towards the corners thereof. One thermal cut-out is provided for each hotplate and is fitted to the associated, downwardly directed end of the support member. These thermal cut-outs can be of a conventional nature and of the type described in the aforementioned specifications. They normally have a bimetal or some other temperature-sensitive member and a switch to be operated in temperature-dependent manner, which opens the circuit at the set temperature. Attachment can be by screwing or fitting on by means of a slip-on or snap in system. Thus, the thermal cut-out is located outside the hotplate and is arranged separately therefrom, being positioned in the space between the mounting plate and the tray cover plate located below it. It can be seen that in each case wire from one of the hotplate terminals 19 passes over the thermostat 20 before, it joins a common cable harness 21 disposed at the outer edge of the cooking tray and running to the associated switches 22. The switches 22 are arranged with respective pilot lamps on a narrow side of the mounting tray.

It can be seen that the thermal cut-out is always located between the hotplate and the edge of the mounting plate, at which possibly flammable objects, such as the cooking tray working plate, can be ignited by excess heat. It is also positioned between the hotplate and the cable harness and the switches and also protects these against excessive temperatures. Due to the fact that each thermal cut-out is associated with the hotplate in whose surroundings it is located, it only switches off the particular hotplate when it responds or operates.

Figure 2:
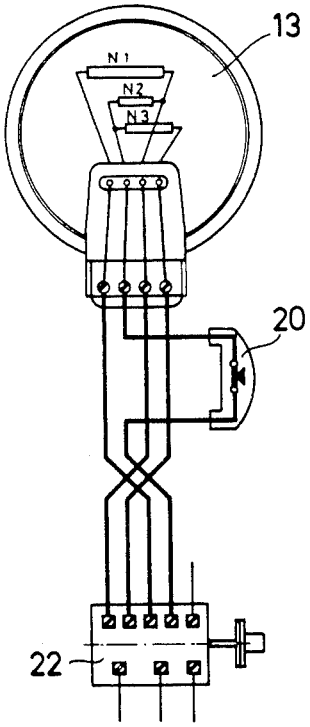
FIGS. 2 to 4 are diagrammatic views of hotplates, thermostats and switches or controls of, in each case, a seven-timing-controlled hotplate and two thermally controlled hotplates.
Figure 3:
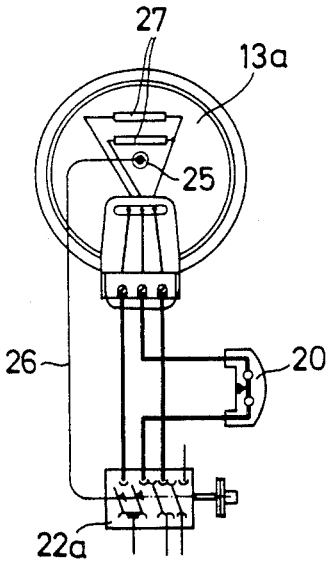
Figure 4:
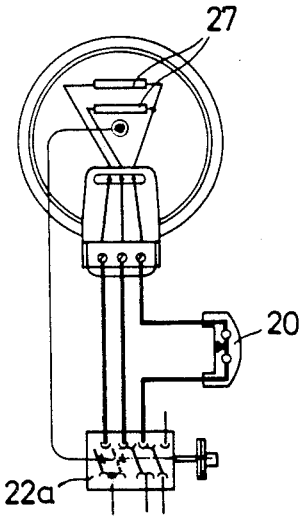

It can be seen from FIGS. 2 to 4 how the thermostat 20 is electrically switched on. FIG. 2 shows the embodiment according to FIG. 1, i.e. a seven-timing switch 22 in conjunction with a corresponding hotplate 13 with three heating conductors N1–N3. Thermostat 20 is switched into the common lead to the two heating conductors N2 and N3 and switches these off when it responds. As the remaining heating resistor N1 in conventional hotplates only has between 1/5 and $\frac{1}{3}$ of the total power, there is a maximum residual power between 250 and 600 W (at the highest switching stage of the seven-position switch), which can never be harmful or dangerous. If there is also an incorporated thermal cut-out, then this power is also disconnected or only an even smaller residual power remains if the fitted thermal cutout only switches off part of the total power.

Figure 5:
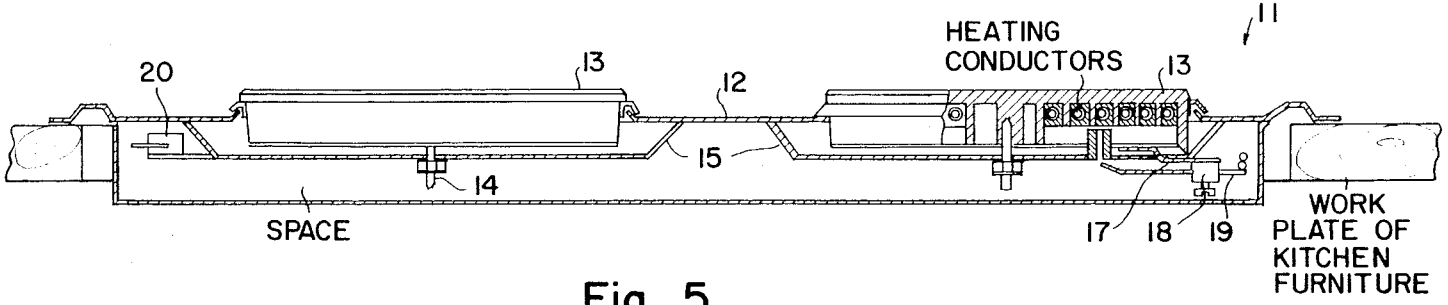
FIG. 5 is a part section view of the apparatus of the invention.

FIGS. 3 and 4 show an embodiment, in which the hotplate is thermally controlled by an adjustable control device **22*a* and namely by means of a hydraulic system with a sensor container 25 filled with expansion fluid and arranged in the center of the hotplate and connected by means of a capillary tube 26 to an expansion tank (not shown) in the control device. In this case, the hotplate 13*a* has two heating resistors 27, i.e. a two-circuit hotplate, which is connected to the control device 22*a* by means of a total of three leads. The expansion tank operates two contacts, which are set to different temperatures, so that on approaching the set temperature, the power is switched off in stepwise manner and in the opposite case is switched on again in stepwise manner. FIG. 5** is partial section view taken through the device of the invention.

FIG. 3 shows an embodiment in which the thermal cut-out 20 is switched into a lead to only one of the two heating resistors, so that only half or a corresponding porportion of the power is disconnected. Further operation with reduced power is still possible after the thermostat has operated, whereas in FIG. 4 the thermostat 20 is located in the complete lead to the two heating resistors 27 and consequently completely switches off the hotplate. It is pointed out that in such a thermally controlled plate, there is only a very limited risk of overheating, because even in the case of a full power setting under no-load conditions, the plate does not reach a dangerous temperature, because the reactive effect of heat from the hotplate on the temperature sensor, which is intended for engagement on the bottom of the hotplate, is so high that the control device lowers the plate setting in good time. However, it is still possible as a result of incorrect fitting, e.g. during a repair, for there to be a transportation of the temperature sensors, in that the temperature sensor belonging to a particular control device is inserted in a hotplate other than the intended hotplate. The control device is then naturally switched off and the hotplate can overheat after switching on and the area surrounding it can become overheated. Thus, here again, the thermostat provides a significant safety advantage.

It is also possible to fit the thermostat at some other point, provided that it is in an appropriate relationship to the hotplate and the object to be protected. For example, a direct fitting to the mounting plate can be advantageous if the plate is made from glass which, although withstanding the normal temperatures which occur, can be damaged in the case of extreme punctiform overheating.

Although according to the preferred embodiment, the thermostat is preferably fitted radially well outside the hotplates, it is also possible to fit it below the hotplate in an effective position, particularly if the surrounding areas to be protected from fire hazard are below the hotplate. It is then advantageous to attach each thermostat to the bottom of the cooker support members. It would also be possible in a constructional variant, where the support member is replaced by a corresponding trough or tray, to fit the thermostat below the trough or tray and consequently optionally between the latter and the metal sheet terminating the cooker towards the bottom.

Particular preference is given to the embodiment in which a particular thermostat is operatively associated with each hotplate. However, it can also be advantageous to operatively associate two thermostats with each hotplate, if e.g. two areas of thermal hazard are located in the vicinity of one hotplate. It is also possible to associated a common thermostat with two hotplates, if e.g. there is only one area of thermal hazard in the vicinity of the two hotplates, e.g. an edge of a wooden mounting plate. A coupling system is also possible, e.g. the association of two thermostats and two hotplates, so that the response of one thermostat leads to the partial or total switching off of both hotplates, can also be advantageous within the scope of the invention.

What is claimed is:

1. A cooker, comprising:

a mounting plate having openings therein for receiving a plurality of electric hotplates;

a plurality of electric hotplates mounted one each in the openings, each of the hotplates having a hotplate body and electrical heating conductor means in the hotplate body, the hotplates being so disposed in the mounting plate that at least part of the hotplate body projects into a bounded space below the mounting plate;

electrical leads connecting the heating conductor means of each hotplate to a source of electrical energy; and, a thermostat connected to at least one of the electrical leads for switching off electrical energy to at least one, but not all of the heating conductor means, the thermostat being disposed in the space, outside of and separately from the hotplate, in a position between the hotplate and an outer boundary of the space, the thermostat switching in response to ambient temperature at the position, whereby an area surrounding the cooker and close to the thermostat position can be protected from localized overheating conditions in the cooker, apart from the hotplates themselves, without entirely disabling the cooker.

2. The cooker of claim 1, comprising a thermostat connected to the heating conductor means of each of the hotplates, whereby a plurality of areas surrounding the cooker can be protected from localized overheating.

3. The cooker of claim 2, wherein the thermostats are located between their respective hotplates and an edge of the mounting plate.

4. The cooker of claim 2, wherein each of the hotplates is held in the mounting plate by a fixing member and the respective thermostat of each hotplate is mounted on the respective fixing member of each hotplate.

5. The cooker of claim 2, wherein the thermostats are provided in lieu of thermal cut-outs for and disposed within each of the cooking plates.

6. The cooker of claim 2, wherein each of the themostats is connected to a flexible lead between the hotplate and a wiring harness connecting the hotplates to control devices.

7. The cooker of claim 2, wherein the thermostats comprise snap-fit attachment means.

8. The cooker of claim 2, wherein each of the thermostats is disposed adjacent an outermost boundary of the space.

9. The cooker of claim 2, wherein each of the hotplates comprises at least two heating elements and each of the thermostats is connected to less than all of the heating elements of the hotplate with which it is operatively associated.

10. The cooker of claim 2, wherein at leastt one of the thermostats is connected to the heating conductor means of more than one of the hotplates.

11. The cooker of claim 2, wherein the mounting plate and the space below the mounting plate have a geometrical configuration defining corners, the thermostats being further positioned in the corners.

12. The cooker of claim 2, wherein at least one of the hotplates comprise at least three separately switchable heating elements and the thermostat operatively connected to the at least one hotplate is connected to at least two, but not all of the heating elements.

13. The cooker of claim 2, wherein at least one of the hotplates comprises three separately switchable heating elements, the thermostat being operatively connected to any two of the heating elements, and further comprising a seven-position switch for controlling the at least one hotplate.

14. The cooker of claim 1, wherein each of the hotplates is an independently operable device having a cast iron body and its own, substantially closed, flat cooking surface on top of the case iron body.

15. The cooker of claim 1, wherein the thermostat is disposed adjacent an outermost boundary of the space.

16. The cooker of claim 1, wherein the hotplate to which the thermostat is connected comprises at least two separately switchable heating elements and the thermostat is not connected to one of the heating elements.

17. The cooker of claim 1, wherein the mounting plate and the space below the mounting plate have a geometrical configuration defining corners, the thermostat being further positioned in one of the corners.

18. A cooker, comprising:

a mounting plate having at least one opening therein for receiving at least one electric hotplate;

at least one electric hotplate mounted in the at least one opening, the at least one hotplate having a hotplate body and electrical heating condutor means in the hotplate body, the hotplate being so disposed in the mounting plate that at least part of the hotplate body projects into a bounded space below the mounting plate;

electrical leads connecting the heating conductor means of the at least one hotplate to a source of electrical energy; and, a thermostat connected to at least one of the electrical leads for switching off electrical energy to at least part of, but not all of the heating conductor means of the at least one hotplate, the themostat being disposed in the space, outside of and separately from the at least one hotplate, in a position between the at least one hotplate and an outer boundary of the space, the thermostat switching in response to ambient temperature at the position, whereby an area surrounding the cooker and close to the thermostat position can be protected from localized overheating conditions in the cooker, apart from the at least one hotplate itself, without entirely disabling the at least one hotplate.

19. The cooker of claim 18, comprising a plurality of the electric hotplates disposed in the mounting plate and a plurality of thermostats, one connected to the electrical heating conductor means of each of the plurality of hotplates, whereby a plurality of areas surrounding the cooker can be protected from localized overheating.

* * * * *

UNITED STATES PATENT AND TRADEMARK OFFICE

CERTIFICATE OF CORRECTION

PATENT NO. : 4,554,438

DATED : November 19, 1985

INVENTOR(S) : Felix Schreder

It is certified that error appears in the above-identified patent and that said Letters Patent is hereby corrected as shown below:

In the abstract, line 7 delete "hotplate" and insert --hotplates--.

Column 1, line 14 change "hotplate" to --hotplates--.

Column 1, line 46 after "with" delete "of".

Column 3, line 9 insert parentheses around "not shown".

Column 3, line 30 after "case" insert --,--.

Column 3, line 56 after "manner" delete ",".

Column 3, line 62 after "case" insert —a--.

Column 3, line 64 after "before" delete ",".

UNITED STATES PATENT AND TRADEMARK OFFICE

CERTIFICATE OF CORRECTION

PATENT NO. : 4,554,438

DATED : November 19, 1985

INVENTOR(S) : Felix Schreder

It is certified that error appears in the above-identified patent and that said Letters Patent is hereby corrected as shown below:

Column 4, line 32 delete "means of".

Column 5, line 29 delete "associated" and insert --associate--.

Column 6, line 26 delete "leastt" and insert --least--.

Column 6, line 34 delete "comprise" and insert --comprises--.

Signed and Sealed this

*Sixteenth* Day of *September 1986*

[SEAL]

*Attest:*

DONALD J. QUIGG

*Attesting Officer*

*Commissioner of Patents and Trademarks*